US005159582A

United States Patent [19]

Ganter

[11] Patent Number: 5,159,582

[45] Date of Patent: Oct. 27, 1992

[54] ELECTROMECHANICAL ALARM CLOCK

[75] Inventor: Wolfgang Ganter, Staatsangehoriger, Fed. Rep. of Germany

[73] Assignee: Junghans Uhren GmbH, Schramberg, Fed. Rep. of Germany

[21] Appl. No.: 591,882

[22] Filed: Oct. 2, 1990

[30] Foreign Application Priority Data

Oct. 14, 1989 [DE] Fed. Rep. of Germany ..... 3934383

[51] Int. Cl.[5] ..... G04B 23/02; G04C 21/00

[52] U.S. Cl. ..... 368/72; 368/262

[58] Field of Search ..... 368/72–74, 368/243, 244, 250, 262

[56] References Cited

U.S. PATENT DOCUMENTS

| | | | |
|---|---|---|---|
| 3,498,047 | 3/1970 | McLeod et al. | 368/262 |
| 3,517,499 | 6/1970 | Keane, Jr. et al. | 368/262 |
| 3,886,723 | 6/1975 | Boyles | 368/262 |
| 4,084,104 | 4/1978 | Scheer et al. | 368/262 |
| 4,242,748 | 12/1980 | Scheer | 368/250 |
| 4,396,297 | 8/1983 | Akahane | 368/262 |
| 4,645,357 | 2/1987 | Allgaier et al. | 368/187 |

FOREIGN PATENT DOCUMENTS 1523873 12/1969 Fed. Rep. of Germany .

1548133 12/1970 Fed. Rep. of Germany .

2317733 10/1973 Fed. Rep. of Germany .

*Primary Examiner*—Vit W. Miska

*Attorney, Agent, or Firm*—Burns, Doane, Swecker & Mathis

[57] ABSTRACT

An electromechanical alarm clock (42) with a variable alarm indicator (48) on a 12 hour time display, for example, of a numerical face plate (44), is designed, without the need for extensive mechanical or electromechanical setting or switching means, to operate over 24 hours, so that an alarm signal (52) will be emitted not 12 hours, but 24 hours after the setting of an alarm signal time. To this end, a blocking time circuit (75) is provided, which operates slightly longer than 12 hours if it is actuated by the manual deactivation of the alarm signal (51), and is based preferably on the counting of pulses from the time keeping clock circuit (45). The blocking time circuit (75) is also reset by a reset switch (71) when another time is set for the emission of the alarm signal, in any case if the new alarm signal emission time is set within the blocking time period (H). The reset switch (71) provided for this purpose may be combined functionally with the setting handle (73) for the setting of the alarm signal.

6 Claims, 1 Drawing Sheet

ELECTROMECHANICAL ALARM CLOCK

FIELD OF THE INVENTION

This invention concerns an electromechanical alarm clock with a 12 hour time display and devices for manual setting of the time display and for manual deactivation of an alarm signal.

BACKGROUND OF THE INVENTION

An alarm clock of this type is known for example from DE-OS 15 48 133. In order to make possible the display of time over the customary 12 hour face, but to prevent the repetition of the alarm signal after 12 hours, the timing of the alarm is set not by means of a trigger hand on the time display scale, but by a separate dial with a 24 hour division. This, however, is not only highly involved mechanically in view of the design possibilities, but is also unusual for the consumer. Also, because of the technically restricted diameter of such a setting dial, the precise setting of the time of alarm is not possible. The same accuracy problems also arise if the incidence wheel for the signal time coincidence inquiry is laid out for a 24 hour division, i.e., for one revolution per two hour hand revolutions.

In order to trigger the alarm only once in 24 hours and still be able to operate with a setting hand over the 12 hour division of conventional face layouts, a contact wheel is provided in DE 15 23 873, which revolves once in 24 hours and limits the alarm release time by means of the contact setting angle of rotation. However, such a contact wheel must be coupled with the dial train moving in a time keeping mode at a correct angle relative to the contact scanning element at the signal release time. This requires a considerable design effort and a large amount of space for installation.

OBJECTS AND SUMMARY OF THE INVENTION

In view of these conditions, it is the object of the invention to equip an electromechanical alarm clock of the aforementioned conventional type in a manner such that, while retaining the alarm time setting in a 12 hour display, the operation of a 24 hour alarm clock is made possible without extensive additional mechanical measures.

This object is attained according to the present invention essentially by an alarm clock of the above-mentioned type equipped for the deactivation of an alarm signal by a blocking switch. The blocking switch starts a blocking time circuit, which in turn blocks with the switched on alarm coincidence circuit sequence. The activation of the alarm signal emitter over a blocking time period of slightly more than 12 hours. The display may be effected in the form of a drop disk or a numerical roll display, but the conventional hand display with a 12 hour division is preferred.

According to the solution of the invention, the "final" deactivation of the ongoing alarm signal starts a blocking time circuit supplied preferentially by the time keeping circuit driving the display. This prevents a repeated actuation of the alarm emitter for slightly more than 12 hours, i.e., it blocks the emission of an alarm signal during the next actuation of the time setting coincidence device. Following this period of time, the actuation of the signal emitter is released so that after another 12 hours—thus 24 hours after the previous signal actuation—an alarm signal is again emitted.

It is possible to change the time of the alarm arbitrarily (for example by altering the alarm hand setting in front of the face plate) during the period of time following the blocking period, without interfering with the actuation of the signal at the newly set time. If, however, following the deactivation of an alarm signal the next point in time is located in the blocking period, the blocking circuit must be reset into its initial release position by means of a reset switch. In order to avoid possible irritation of the operator (as the result of forgetting the reset operation) it may be convenient to combine the function of the reset switch with the manual activation of the setting handle for the alarm hand, i.e, to actuate the reset switch for example by means of a loop or a pressure contact, whenever the setting shaft is rotated or depressed.

DESCRIPTION OF THE DRAWINGS

Further alternatives and developments, together with other characteristics and advantages of the invention are set forth in the claims and the abstract, the following description of a preferred example of embodiment shown in the drawings, in the form of a single pole block diagram of the solution according to the invention. In the drawings:

DETAILED DESCRIPTION OF THE PREFERRED EMBODIMENT

Figure 1:
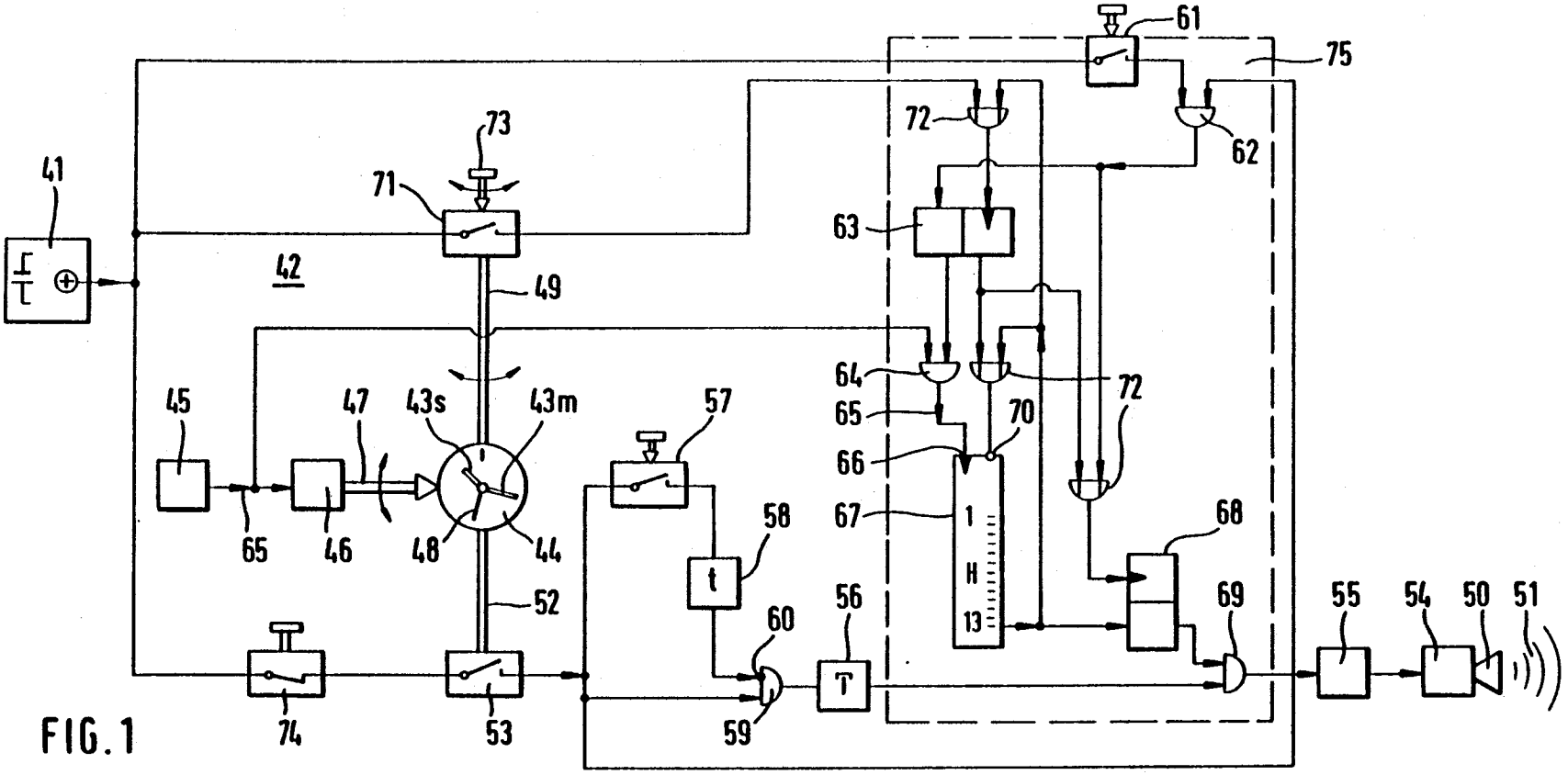
FIG. 1 shows a manually actuable blocking means of a repetition of an alarm signal after 12 hours, and FIG. 2 the effect of the blocking in the time diagram.

A electromechanical alarm clock 42, operated for example by means of a battery 41, with a 12 hour time display by means of hour and minute hands 43 before a 12 hour numerical face 44 has a time keeping circuit 45 (for example as a quartz stabilized oscillator with a pulse frequency reducer), which moves the hands 43 correctly in time by means of an electromechanical transducer 46 and a reducing gear 47. To simplify the drawing it is not shown that conveniently a periodic hands setting query is provided, in order to compare the prevailing time display with the absolute time information received by radio and potentially to correct it, as described in detail in U.S. Pat. No. 4,645,357 to Allgaier et al, the disclosure of which is incorporated herein by reference.

The clock 42 additionally has an alarm hand 48, which may be set manually by means of a setting shaft 49 on the time in the minute works of the face 44, at which an electroacoustic signal emitter 50 is to be actuated to emit an alarm signal 51.

When the hour hand 43*s* reaches the angular position onto which the alarm hand 48 has been set, a mechanical or electromechanical coincidence device 52 is actuated and closes a switching sequence 53 to actuate the signal emitter 50, possibly through a terminal amplifier 54 from an electromechanical or preferably an electronic tone frequency generator 55. A time limit circuit 56 included in the switching sequence, prevents the unnecessary use of the battery 41 if the emission of the alarm signal is not deactivated manually (see below), such as when the operating conditions during the query of the angular position of the alarm hand 48 by the hour hand 43*s* rotating at a very low angular velocity. During this time, the switching sequence 53 would remain closed for a longer period of time, until the mechanical coincidence (the so-called indicator drop into the clock movement behind the face 44) is eliminated and the signal 51 terminated.

The temporary manual interruption of the alarm signal 51 is effected by a snooze push button 57 to start a momentary timer 58, after the signal emitter switching sequence 53 has been closed, in order to temporarily block an AND element 59 through its inverting inlet 60, thereby temporarily interrupting the emission of the alarm signal 51, until following the expiration of the snooze time t it is resumed. The alarm signal 51 is not resumed after repeated manual actuation of the snooze switch 57 for a limiting time period T, which for example is of the order of magnitude of five times the snooze repetition time t.

Figure 2:
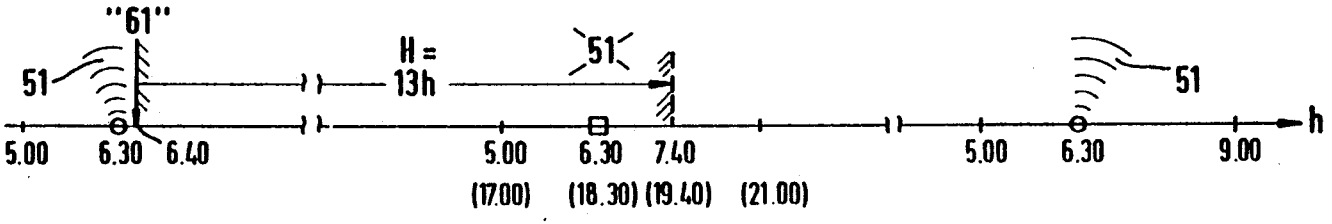

If, for example, (FIG. 2) the alarm indicator 48 is set to 6.30 hours, the hour hand 43*s* would again actuate after one revolution, i.e., 12 hours later, the coincidence device 52 and again trigger an alarm signal 51 at 6.30 PM, i.e., at 18.30 hours, although the alarm signal is needed in the morning only. The prevent this, a day block switch 61 is provided, which (optionally after the repeated use of the snooze switch 57) "finally" interrupts the alarm signal 51 just 12 hours later, i.e., to prevent the repeated emission of the alarm signal (symbolized by the crossed out indication in the center of FIG. 2). For this, if the coincidence switching sequence 53 of the clock 42 is still closed, in a day blocking time circuit 75 by means of an AND gate 62 a bistable flip-flop connection 63 is set, which switches through an AND element 64 a time keeping pulse sequence 65 (preferably supplied by the time keeping circuit 45 driving the hands 43) to the counter inlet 66 of a blocking counter 67. Simultaneously, a bistable connection 68 is set through a dynamic inlet (represented by a triangular pulse signal), so that an AND gate 69 is blocking during the actuation of the signal emitter 50. This block is eliminated only when a period of time of 12 hours, together with the compensating play in the coincidence device 52, has expired, for example a blocking time period of 13 hours. Therefore, if the blocking counter 67 is initiated shortly after the onset of the alarm signal 61, the blocking gate 69 continues after an hour hand revolution (at 18.30 hours) and in the afternoon of the day in which in the morning the blocking switch 61 has been actuated, no alarm signal is emitted. (FIG. 2 in the center). Only after for example 13 hours following the actuation of the blocking switch 61 (i.e., in the case of FIG. 2 at 19.40 hours) has the blocking counter 67 completed its count up to its terminal position, from which it resets itself over its reset inlet 70 together with the blocking element 68, so that the blocking gate 69 is again released. However, the switching sequence 53 is then no longer closed, so that an alarm signal 51 is emitted again only at the next time coincidence point (in this example at 6.30 hours, the next morning).

The operation described above is not affected by the alarm hand 48 being moved to another signal emission time during the running time of the blocking counter 67 or after it, for example to 5.00 hours or 9.00 hours in the morning. After H hours following the actuation of the day blocking switch 61, the emission of the alarm signal 51 at the time set on the face 44 resumes. Only the advance of the next alarm signal emission time into the period of time of the actuated blocking time H is ineffective, e.g., a new signal setting for 5.00 (17.00) hours on the same afternoon, after the deactivation of the signal at 6.40 hours.

To eliminate this restriction, a reset switch 71 may be provided, which by the OR gate 72 resets the flip-flop connections 63 and 68, which possibly are still set to block the signal emission, and the blocking counter 67 independently of its momentary count, into its initial counting position. The blocking gate 69 is thereby released even prior to the expiration of the blocking period H and at the next coincidence time point (i.e., prior to the expiration of the otherwise effective blocking time H) an alarm signal 51 is again emitted.

As such a reset switch 71 is to be actuated only if and when a change in the time of the signal emission is intended (actually only into the blocking time period H), and to avoid an excessive number of switches to be actuated separately on the alarm clock 42, the reset switch 71 may be advantageously provided in functional combination with the actuation of the setting shaft handle 73. This is indicated in FIG. 1 symbolically by the inclusion of the switch 71 in the operation of the setting shaft 49, such as disclosed in FIG. 3 of DE-AS 23 17 733. Therefore, whenever the signal emission setting is altered by setting the alarm indicator 48, the reset switch 71 is closed and thereby the gate 69 for the actuation of the signal emitter 50 released, as soon as the coincidence device 52 responds as the result of the setting of the hour hand.

In order to completely deactivate the alarm signal emission function (for example over the weekend), an operating switch 74 may be provided in front of the feeder inlet (as shown in FIG. 1) or after the signal outlet of the alarm emission switching sequence 53. Furthermore, in order to reduce the number of switching handles to be mounted individually on the alarm clock 42, it may be convenient to combine the blocking switch 61 and the operating switch 74 into a multifunction switch, which for example carries out a catch function upon activation in one direction as the operating switch 74 and upon actuation in the other direction—i.e., following the actuation of the operation—a push button function as the blocking switch 61.

To further simplify the operation, the snooze switch 57 is not electromechanical but electronic, for example by means of a reflection beam barrier, as described in detail in U.S. Pat. No. 3,498,047 incorporated herein by reference.

If the time keeping circuit 45, or the aforementioned control and correction of the momentary hand setting in keeping with an absolute time information, is equipped with a not fully utilized signal processor, it is convenient, in contrast to the fundamental diagram of FIG. 1, to carry out the individual time and blocking functions not by means of discrete digital circuits, but to utilize the possibility of memory programmed controls in the processor, wherein the connecting functions of the logic gates may also be carried out by multiplex time queries.

Although the present invention has been described in connection with the preferred embodiments thereof, it will be appreciated by those skilled in the art that additions, modifications, substitutions, and deletions not specifically described may be made without departing from the spirit and scope of the invention as defined in the appended claims.

I claim:

1. An electromechanical alarm clock with a 12 hour time display, said alarm clock comprising:

means for generating an alarm signal;

means for manually setting an alarm signal time on the 12 hour time display;

an alarm coincidence circuit for actuating said alarm signal generator means upon the coincidence of a set alarm time and the time indicated on the 12 hour time display;

a blocking switch;

a blocking time circuit, started by actuation of the blocking switch, for blocking the actuation of the alarm signal generating means over a blocking time period of slightly more than 12 hours, said blocking being released thereafter.

2. Alarm clock according to claim 1, wherein said blocking time circuit comprises a counter cycled by a time keeping circuit of the alarm clock.

3. Alarm clock according to claim 1, further comprising a reset switch for resetting the blocking time circuit to the initial state and eliminating the blocking of the alarm signal generating means.

4. Alarm clock according to claim 2, further comprising a reset switch for resetting the blocking time circuit to the initial state and eliminates the blocking of the alarm signal generating means.

5. Alarm clock according to claim 3, further comprising a setting handle for setting the alarm signal time, wherein the reset switch is functionally combined with the actuation of the setting handle.

6. Alarm clock according to claim 4, further comprising a setting handle for setting the alarm signal time, wherein the reset switch is functionally combined with the actuation of the setting handle.

* * * * *